US011064792B2

(12) United States Patent
Neibarger

(10) Patent No.: US 11,064,792 B2
(45) **Date of Patent: *Jul. 20, 2021**

(54) CARRIER SYSTEM

(71) Applicant: LONDON BRIDGE TRADING INC., Virginia Beach, VA (US)

(72) Inventor: John E. Neibarger, Virginia Beach, VA (US)

(73) Assignee: LONDON BRIDGE TRADING INC., Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/544,780

(22) Filed: Aug. 19, 2019

(65) Prior Publication Data

US 2020/0069036 A1 Mar. 5, 2020

Related U.S. Application Data

(63) Continuation of application No. 15/484,518, filed on Apr. 11, 2017, now Pat. No. 10,383,425, which is a continuation of application No. 14/150,409, filed on Jan. 8, 2014, now abandoned, which is a (Continued)

(51) Int. Cl.

| | |
|---|---|
| ***A45F 3/04*** | (2006.01) |
| ***A45F 3/14*** | (2006.01) |
| ***A45F 3/00*** | (2006.01) |
| ***F41H 1/02*** | (2006.01) |
| *A45F 3/06* | (2006.01) |

(52) U.S. Cl.

CPC ..... *A45F 3/04* (2013.01); *A45F 3/00* (2013.01); *A45F 3/14* (2013.01); *F41H 1/02* (2013.01); *A41D 2400/48* (2013.01); *A45F 3/06* (2013.01); *A45F 2003/001* (2013.01); *A45F 2003/144* (2013.01)

(58) Field of Classification Search

CPC ..... A45F 3/00; A45F 3/14; A45F 3/06; A45F 2003/001; A45F 2003/144; A45F 3/08; A45F 2003/146; A45F 2003/045; A45F 3/005; A45F 3/04; A45F 3/10; F41H 1/02; A41D 2400/48; A61F 5/028

USPC ..... 224/576, 625, 631, 641, 628, 633, 630, 224/634–638, 262–263, 611; 2/2.5

See application file for complete search history.

(56) References Cited

U.S. PATENT DOCUMENTS

| | | | | |
|---|---|---|---|---|
| 7,337,935 | B1 * | 3/2008 | Glanville | A45F 3/04 224/262 |
| 2005/0082330 | A1 * | 4/2005 | Fehlberg | A45F 3/047 224/631 |
| 2006/0266781 | A1 * | 11/2006 | Howell | A45F 3/08 224/628 |

FOREIGN PATENT DOCUMENTS

| | | | | |
|---|---|---|---|---|
| DE | 10000595 | A1 * | 10/2001 | A45F 3/08 |
| WO | WO-2008089128 | A2 * | 7/2008 | F41H 1/02 |

* cited by examiner

*Primary Examiner* — Nathan J Newhouse
*Assistant Examiner* — Matthew T Theis

(57) ABSTRACT

A carrier system for use with a body armor garment that distributes the shoulder loads produced by equipment carried or worn by military or law enforcement personnel, away from the user's shoulders and comfortably to the hips. Heavy shoulder loads, which typically cause chronic back pain and can lead to compression of the spine, are significantly mitigated. The carrier system has a vertical back support and a belt for securing the device around the waist of the user. In addition to alleviating shoulder fatigue and spine compression, the device is light, comfortable, durable, adjustable and easy to maintain.

20 Claims, 5 Drawing Sheets

Related U.S. Application Data continuation-in-part of application No. 12/800,772, filed on May 21, 2010, now abandoned.

(60) Provisional application No. 61/180,524, filed on May 22, 2009.

CARRIER SYSTEM

CROSS-REFERENCE TO RELATED APPLICATION

The present application is a continuation of U.S. patent application Ser. No. 14/150,409, filed Jan. 8, 2014, which is a continuation-in-part of U.S. application Ser. No. 12/800,772 titled "Carrier System" filed on May 21, 2010, which claims the benefit of the priority of U.S. Provisional Application No. 61/180,524, filed May 22, 2009, all of which are incorporated herein by reference in their entirety.

BACKGROUND

Field of the Disclosure

The present invention relates to a carrier system for use with garments such as body armor vests.

Background of the Disclosure

Whether in police or security operations, military operations other than war, or combat, the need for ballistic resistant garments or body armor is well established. Body armor vests are garments with pouches that are adapted to contain pieces of ballistic armor. Ballistic armor generally comprises ceramic or metallic plates for the protection of portions of a wearer's body. The vests are often constructed of flexible fabric that is sufficiently durable for the contemplated application.

Body armor capable of offering enhanced protection from higher caliber projectiles or those protecting a greater amount of surface area of the body can be heavy. This load is borne entirely on the shoulders of the user.

Current body armor systems are typically adapted for the circumstances of use. For example, in policing embodiments, a body armor vest might be outfitted with various additional pockets, loops, or straps for carrying required policing equipment. The body armor vest is attractive as a carrier system because it frees the waist and legs of the individual, enabling a greater range of ambulatory activity. Additional gear such as backpacks, armament or mobile communication equipment are often carried on top of the body armor using shoulder straps thereby adding more load to the shoulders. Straps can also interfere with visibility, movement, and may need attention from the wearer if they break or need adjustment. Straps can also allow the load to be further from the wearer allowing the load to shift in difficult terrain.

A disadvantage of conventional body armor carrier systems is that it transfers much of the weight of the equipment, ammunition, etc., to the shoulders of the wearer. Of course, this is in addition to the weight of the armor or any shoulder born back pack. In some military applications, for example, the combined weight of armor and equipment may be 100 pounds or more. This arrangement can rapidly lead to fatigue and, in some cases, compression of the spine. Spinal compression or back injury has become common among some military personnel because of such great loads.

Some conventional efforts to address this have involved arches or similar supports cantilevered over the wearer's shoulders. Unfortunately, this approach can be unstable and may create a moment that works to apply a negative force to the abdomen.

It would be desirable to have a carrier system that enables a person wearing a ballistic vest freedom of movement for ambulatory activity without overloading the back or abdomen of the wearer. Further it would be desirable if the carrier system assisted in distributing other shoulder borne loads to the waist without the need for additional equipment.

SUMMARY OF THE INVENTION

This disclosure describes a carrier system for use with ballistic garments having a shoulder strap adapted to transfer a shoulder load to the shoulder of a user having a flexible and adjustable waist strap adapted to encircle the user's waist. The waist strap has at least two ends and a fastening device for detachably securing the ends and a semi-rigid upright support member attached to the waist strap at a portion of the waist strap substantially midway between the waist strap ends and corresponding to the user's back. The upright support member extends vertically for a desired length along a user's back. The upright support member has a side facing the user, an opposing exterior side, and an upper edge with at least one portion of the upper edge extending in a vertical direction beyond the height of the user's shoulders.

In an embodiment, the upper edge extends in a vertical direction up to but not exceeding the height of the wearer's chin, and not substantially extending horizontally over the wearer's shoulder.

An embodiment of the carrier system is that it is adaptable for use with a body armor vest.

In another embodiment the upright support member has an upper edge with at least one tab that extends in a vertical direction beyond the height of the user's shoulders adaptive to receive at least a portion of any shoulder load holding the load in compression through the upright support member and directly to the hips of the user. In such an embodiment, as before, the upright support member does not extend over the wearer's shoulders.

In yet another embodiment the at least one tab has two or more tabs situated on the upper edge at a point corresponding laterally to the user's shoulders. These tabs may lift shoulder straps or a loaded vest.

In another embodiment, the upright support member is ergonomically contoured to follow the contour of the user's back.

In another embodiment, the upright support member is attached to the belt in a manner that permits the upright support member to rotate laterally from side to side with respect to the belt.

The support member may further have at least one cushion situated on a side facing the back or hips of the user.

An aspect of another embodiment of the carrier system is a body armor carrier system, where the carrier system has a body armor vest having a downwardly open sleeve or support pocket on the back that situates over the upright support member upper edge where the body armor load is distributed over the upper edge and to the hips of the user through the upright support member and belt.

Another aspect of the invention is a body armor vest, with a fabric vest having at least one armor pouch adapted to receive a piece of armor with the rear of the fabric vest facing away from the user having at least one downwardly open guiding sleeve or support pocket. There is at least one flexible first side portion connecting the vest front with the vest rear, and at least one flexible second side portion connecting the vest front with the vest rear. The system also includes an adjustable waist belt having a semi-rigid upright support member extending in a vertical manner for about the length of a wearer's back, attached to the belt at the portion of the belt corresponding to the wearers back, the support member having an upper edge; and wherein the support member is adapted to engage with the support pocket or guiding sleeve and the upper edge of the support member is adapted to receive a load.

In another embodiment the additional loads, such as armament, communications devices, backpacks or military issue gear, may be quickly mounted or removed from the carrier system without the need to use an additional backpack frame and without the need to fasten loads to the carrier system.

In yet another embodiment the loads over the body armor will be closer to the body than with conventional frames systems providing a smaller user profile from front to rear with minimal restrictions to user mobility. Additionally, this may aid in improved peripheral visibility and a lower center of gravity for increased stability.

In yet another embodiment the carrier system is simple to construct with low cost to manufacture and with increased reliability due to few parts that can fail. It is lightweight and compact requiring no modifications or adjustments to be made by the user when carrying additional loads.

These and other advantages of the invention will be further understood and appreciated by those skilled in the art by reference to the written specification, claims and drawings.

DETAILED DESCRIPTION OF THE DRAWINGS

The present disclosure relates to a carrier apparatus and carrier system for use with garments such as body armor vests. With reference to the drawings, the present disclosure is a carrier system that enables ambulatory activity by transferring the load from the shoulders to the hips of the user without overloading the back of the user. The carrier system may take any of a variety of embodiments disclosed herein.

Figure 1A:
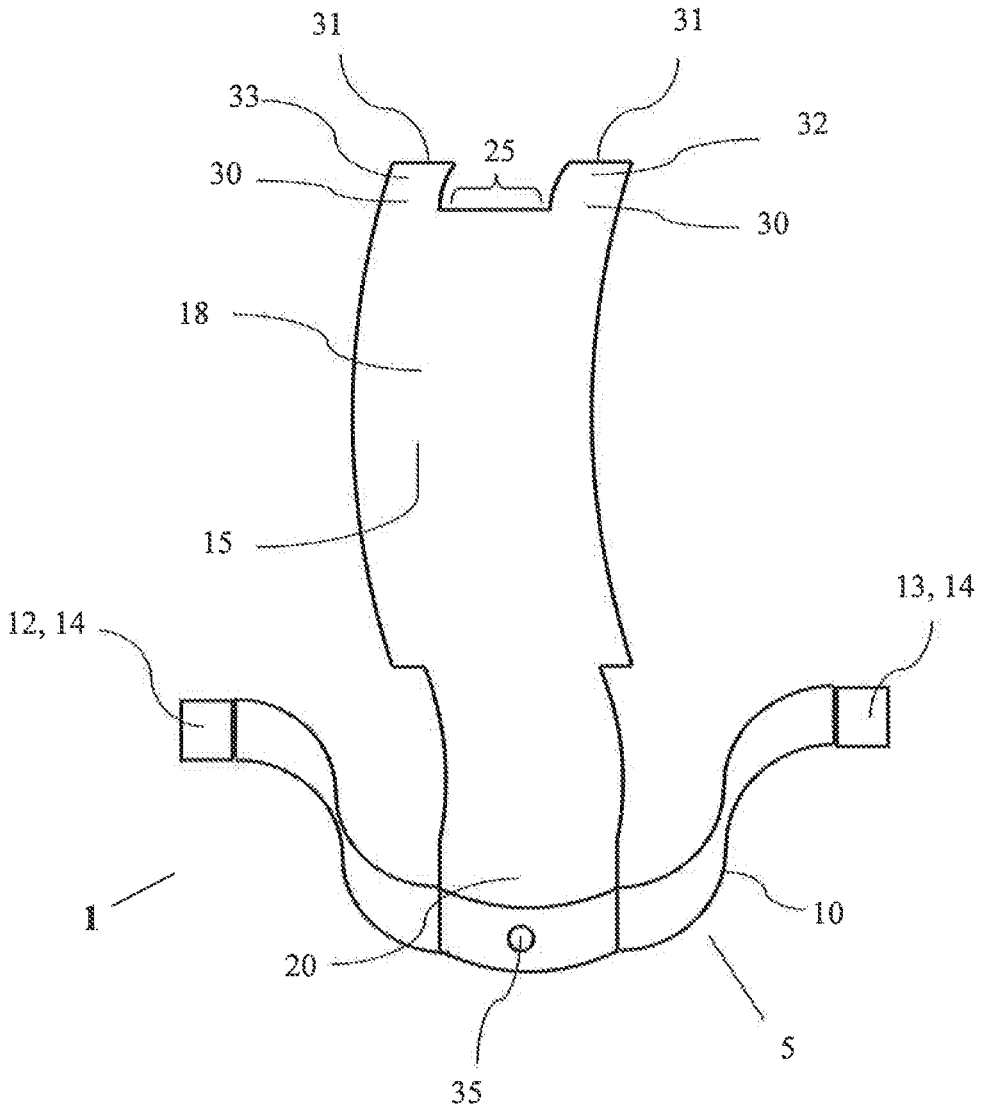
FIGS. 1A and 1B are isometric views of embodiments of the invention.
Figure 1B:
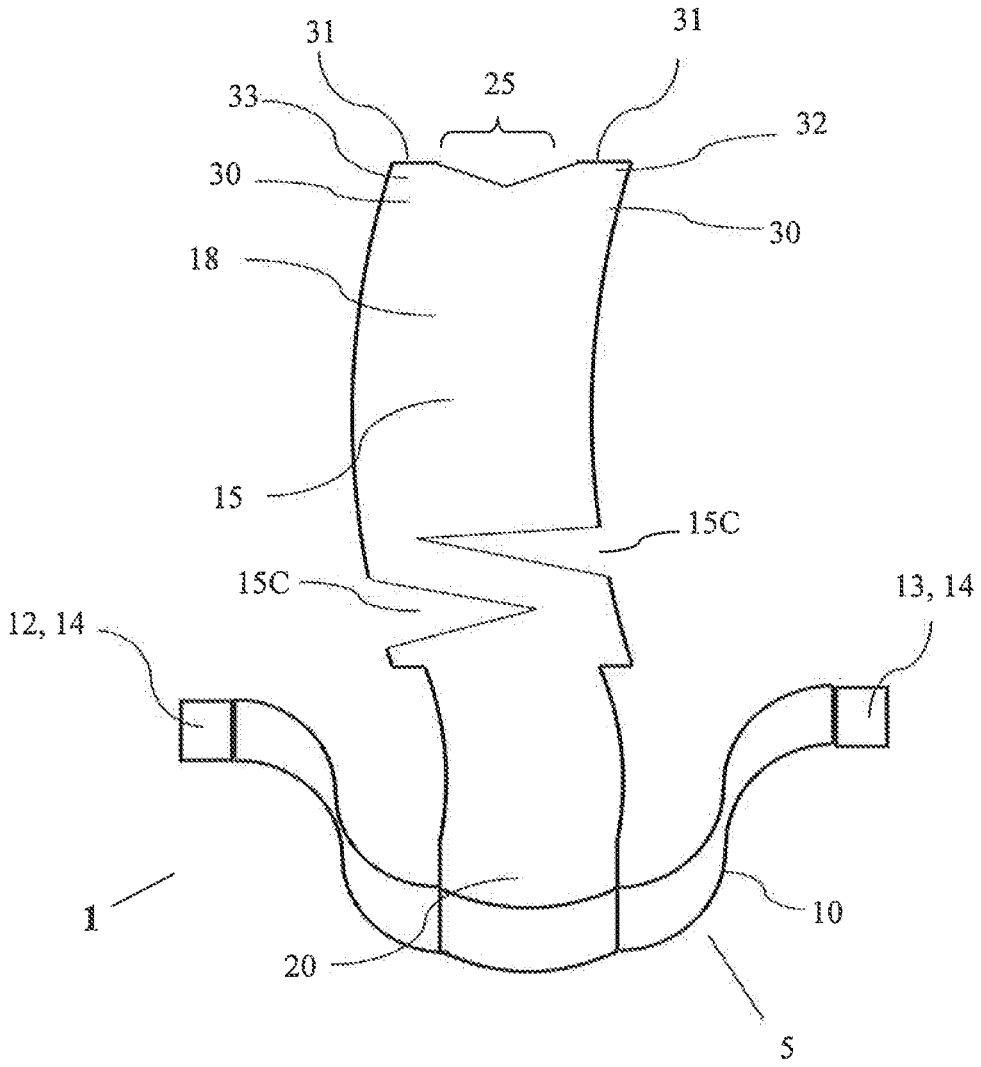
Figure 2:
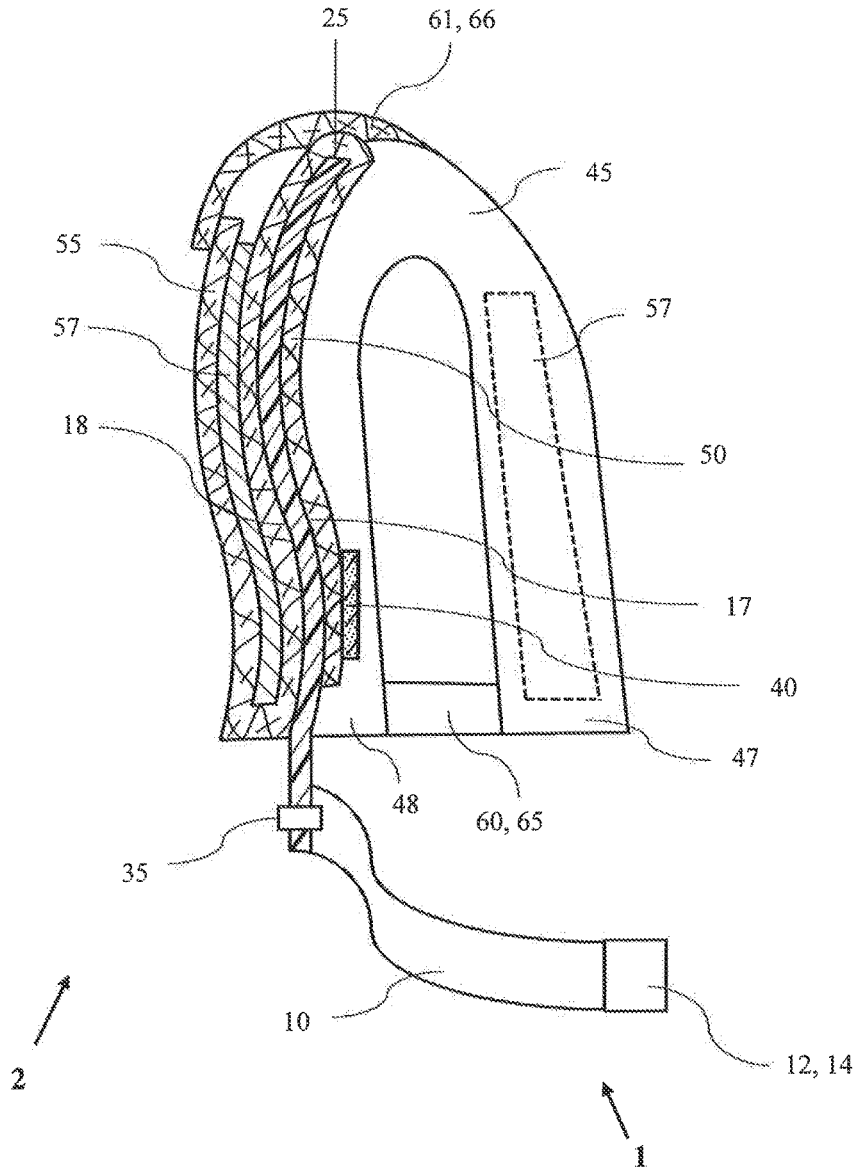
FIG. 2 is a sectional view of an embodiment of the invention.

As may be seen in FIGS. 1-2, an embodiment of the carrier apparatus 1. The belt 5 includes a flexible and adjustable waist strap 10 having an upright support member 15 attached to the belt 5 at the mid-portion 20 of the strap corresponding approximately the center of the waist strap 10 which will approximate the middle of the wearers back. The waist strap 10 has at least a first end 12 and a second end 13 that are releasably closable with a fastening system 14 which may include a clasp, buckle, hook and loop, clamp, clip or other device for securing the ends of the waist strap 10 or belt 5 in front of a wearer, generally where a belt buckle would reside near to the center of the hips. The upright support member 15 extends in a vertical manner along and for approximately the length of a wearer's back. The support member 15 has a central upper edge 25 and a wearer facing side 17 and an opposing exterior side 18. The support member 15 is from one to eighteen inches in width and may have sides that are relatively parallel to each other or of specific shapes such as a narrow base at the belt 5 and a widening at the central upper edge 25 of six to eighteen inches to accommodate shoulder widths. The support member 15 may be perforated or shaped for removal of unnecessary weight without compromising the load bearing integrity. For example, as detailed in FIG. 1B, support member 15 may define one or more cutouts 15C or perforations to reduce weight and enhance breathability. In some embodiments, as shown, support member 15 may define two proximal triangular cutouts 15C in opposing relation. That is, with cutouts 15C defined from opposing sides, proximally disposed, such that a portion of the support member 15 is in the form of a substantial diagonal running along the wearer's back between cutouts 15C, leaving an overall Z-shape. In this embodiment, support member 15 may be adapted to a desired level of deformation upon impact, narrowing the cutouts 15C and absorbing some of the shock in a manner of semi-rigid response without the need for the additional structure of a shock absorber, such as a coil spring or sprung dashpot.

The material of the upright support member 15 may be rigid or semi-rigid and made of metal or plastic, polycarbonate, acrylic, carbon fiber or a combination of materials including structural foam with the thickness of material relative to the vertical loading. However, polycarbonate has proven to be an effective and light weight material sufficient to bear the weight of contemplated loads at a relatively reasonable expense, and further is reasonably amenable for use in manufacture.

The central upper edge 25 extends in the vertical direction, at or below the height of the wearer's shoulders (not shown). The upright support member has the central upper edge 25 and features at least two upper tabs 30 or elevated points that extend in a vertical direction greater than the height of the wearer's shoulders. The concept of tab 30 is to lift the load from the shoulder, so it may simply be an elevated or upper portion of support member 15 without reaching or extending over the shoulder of the wearer. The at least one tab 30 may be a first tab 32 and a second tab 33 situated on the central upper edge 25 at a point corresponding to the wearer's shoulders. The spacing of the first tab 32 to the second tab 33 is between 6 inches and 18 inches allowing for a shoulder strap from an additional back borne load (FIG. 3) to be properly placed such that the load is in the proper position on the wearer's back and only the shoulder straps contact the first tab 32 and or the second tab 33. This prevents the shoulder straps from contacting the top most part of the shoulders and thus bearing the weight through the respective tabs 30 and through the upright support member 15 downwardly to the user's hips. Adjustments to the shoulder straps do not change the shoulder strap position on the two upper tabs 30 above the shoulder. In this configuration, the upright support member 15 central upper edge 25 height is below the at least one tab 30. This prevents interference with the neck of a wearer. Generally the two upper tabs 30 are from 0.1 inches to about 3.0 inches above the adjacent central upper edge 25. In relation to the height of the upright support member 15, the ratio may be between 5-16% percent. The two upper tabs 30 may be vertical or curvilinear (See, e.g., FIGS. 3A & B) to conform to the back of a wearer's shoulder contour. Tabs 30 might also be in the form of raised portions of a rough V-shape. The tab end 31 on the two upper tabs 30 may be substantially flat and perpendicular to the upright support member, angled or shaped with features such as an indentation, concave, vee, one or more ribs, convex or undulating to retain the pack straps on the two upper tabs 30. Undulating is defined as having a curvature along the shoulder and a curvature of one or more sides similar to a wave. This is to be distinguished from extending substantially over a shoulder in a horizontal manner.

The difference in height between the two upper tabs 30 and the central upper edge 25 allows for the user to look up without contacting the central upper edge 25 of the upright support member 15. Also, for the optional embodiment shown, the upright support member 15 is be ergonomically contoured to follow the contour of the wearer's back.

In some embodiments, upright support member 15 may be attached to the belt 5 at mid-portion 20 in a manner that permits the upright support member 15 to rotate laterally with respect to the waist strap as a wearer might lean from side to side. The optional pivoting attachment 35 may be a single point such as a central pin or multiple points. In addition, some embodiments may have an upright support member 15 that further has at least one cushion 40 situated on a side facing the back or hips of the wearer, as shown in FIG. 2.

FIG. 2 also shows a carrier system 2 for use with a body armor vest 45. In this example, the carrier system 2 includes a vest 45 having a downwardly open support pocket or support guiding sleeve 50 on the interior portion of the back of the vest 45 in relation to the user. The downwardly open support pocket or guiding sleeve 50 is marginally larger than the upright support member 15 so that it might slide over the two upper tabs 30 and the upright support member 15 until the two upper tabs 30 and/or the central upper edge 25 are fully engaged within the downwardly open support guiding sleeve 50 thereby removeably securing the vest 45 to the carrier apparatus 1. The words "pocket" or "sleeve" are intended to convey a receiving fabric cavity, such that when upright support member 15 and support sleeve 50 (i.e., with such sleeve closed at an upper end) are engaged or mated, then vest 45 is operably supported or carried by support member 15. The central upper edge 25 and first tab 32 and second tab 33 may be adapted to the contour and shape of the closed end of the downwardly open support pocket or sleeve 50, so as to mate closely or more securely engage. The downwardly open support pocket or guiding sleeve 50 may range in length from the full height of the vest 45 to a portion of the height of the vest 45. The downwardly open support guiding sleeve 50 may have features, such as receptacles, at the closed end to accommodate the two upper tabs 30.

Also shown in FIG. 2 is a vest 45 with a fabric outer coating where the vest 45 has at least one armor pouch 55 adapted to receive a ballistic armor insert 57. The armor pouch 55 may be closed at the bottom and closeably open at the top or closed at the top and be closeably open at the bottom, as in the case of waterborne personnel. The vest 45 also has a first shoulder strap 61 and a second shoulder strap 66. The vest 45 has at least one downwardly open support pocket or guiding sleeve 50, at least one flexible first side portion 60 connecting the vest front 47 with the vest rear 48, and at least one flexible second side 65 portion connecting the vest front 47 with the vest rear 48. The upright support member 15 has a central upper edge 25, and is adapted to engage with or be inserted into the downwardly open support guiding sleeve 50, at which point the central upper edge 25 of the upright support member 15 receives a load (FIG. 3) that would otherwise be borne solely by the shoulders of the wearer.

Figure 3A:
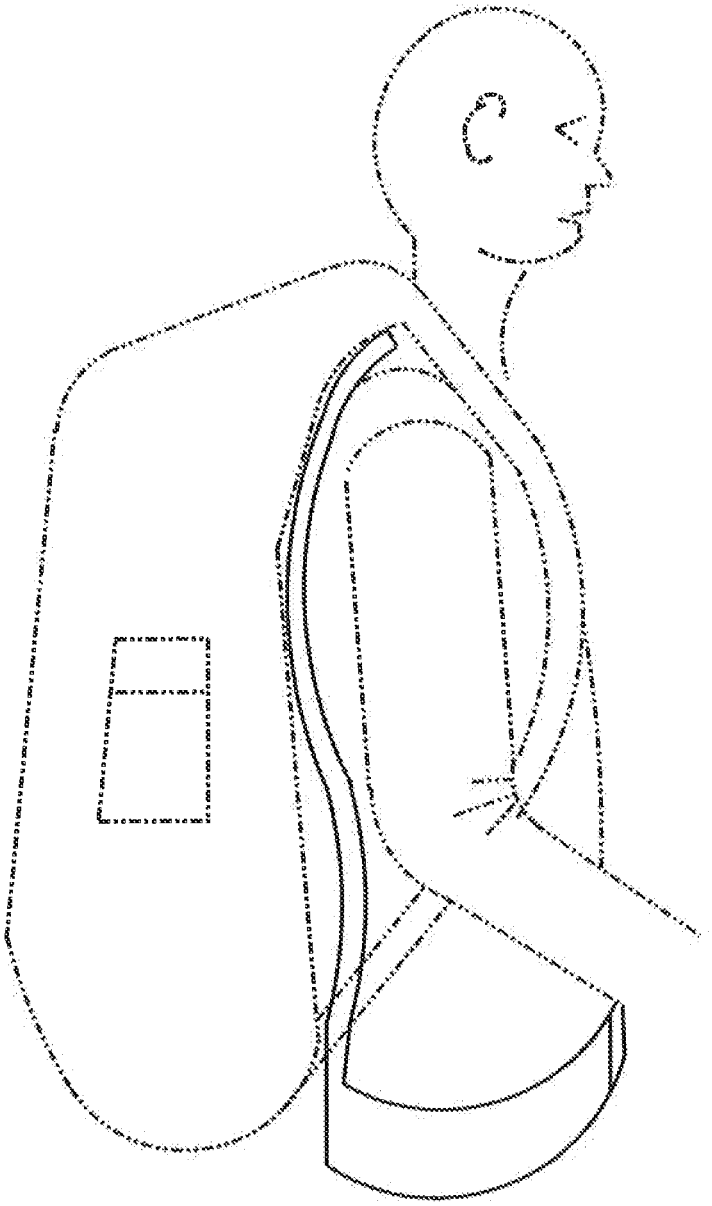
FIGS. 3A and 3B show a shoulder load with straps on an embodiment of the invention.

The load shown in FIG. 3A may be installed on the carrier apparatus 1 or the carrier and vest system 2, interchangeably.

Optionally, the upright support member 15 has the central upper edge 25 below the shoulder height approximately at the junction of the seventh cervical vertebrae and the first dorsal vertebrae and the two upper tabs 30 extending in a vertical direction above the height of the wearer's shoulders.

Figure 3B:
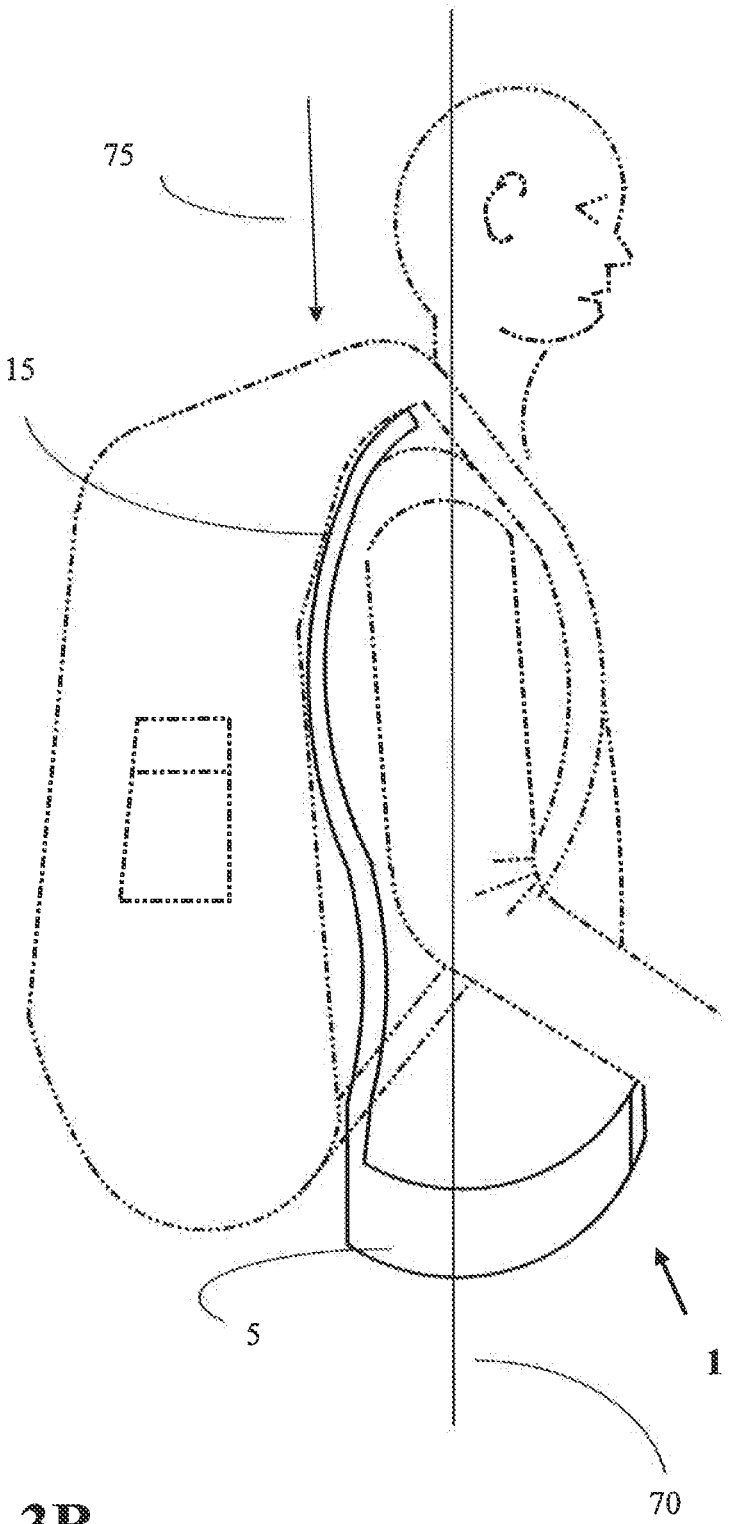

As shown in FIGS. 2 and 3A, 3B, the upright support member 15 may be ergonomically contoured to follow the contour of a wearer's back, but without upper tabs 30 or support member 15 extending horizontally over, or arching, substantially over the wearer's shoulder. In this case, substantially over or extending may be understood as breaking a transverse vertical plane 70 (FIG. 3B) running through the center of the shoulder.

The present approach is directed to communicate a downward force along the essentially upright support member 15, so as to load belt 5 downwardly at the hips of the wearer, as illustrated with arrow 75. An extension in a horizontal direction over the shoulders of the wearer, while possibly lifting the straps off shoulders, would displace the force away from the support member—i.e., away from arrow 75. Substantially extending over the shoulder can unnecessarily create a bending moment on the device. To address this moment, that design would require choosing a material with suitable flexural rigidity, such as a stiff, expensive form of carbon fiber. In addition, such a bending moment could create undesirable coupling forces as the device may attempt to pivot about the wearer. This might apply a horizontal force to belt 5, causing it to press against the abdomen.

In some embodiments, upright support member 15 may be attached to the belt 5 in a manner that permits the support member to rotate laterally with respect to the belt 5. In other embodiments, upright support member 15 may define two cutouts as discussed above; appropriately sized cutouts in opposing edges may enable a semi-rigid support member 15 that provides similar rotary flexure.

In some embodiments, upright support member 15 may further comprises at least one cushion 40 situated on a side facing the back of the wearer.

In the foregoing description, it will be readily appreciated by those skilled in the art that modifications may be made to the invention without departing from the concepts disclosed herein. Thus, while the description above refers to particular embodiments, it will be understood that many modifications may be made without departing from the spirit thereof.

What is claimed is:

1. A ballistic armor carrier comprising:

a pair of shoulder straps configured to be worn on a wearer's shoulders;

at least one holder configured to receive a ballistic armor insert;

a waist support member configured to secure the carrier around the wearer's waist at a vertical location substantially corresponding to the wearer's hips; and an upright support member attached to the waist support member at a location substantially corresponding to the lateral middle of the wearer's back, the upright support member including a lower support portion extending vertically from the waist support member, and an upper support portion extending from the lower support portion to a position above a height of the wearer's shoulders;

wherein the lower support portion includes an inward contour configured to at least partially conform to the wearer's lower back, and the upper support portion includes an outward contour configured to at least partially conform to the wearer's upper back, wherein the upper support portion includes a central upper edge and at least two upper tabs that extend in a vertical direction beyond the central upper edge and vertically above the height of the wearer's shoulders, but not exceeding a height of the wearer's chin and not substantially extending horizontally over the wearer's shoulders;

wherein the at least two upper tabs are laterally separated from each other by the central upper edge and are disposed at lateral locations on the upper support portion corresponding to the wearer's shoulders, with the central upper edge disposed at a vertical location on the upper support portion no higher than the height of the wearer's shoulders;

wherein the at least two upper tabs are configured such that the upright support member receives at least a portion of a shoulder load via the shoulder straps and the at least two upper tabs, with at least a portion of the shoulder load being transmitted downwardly through the at least two upper tabs and the upright support member to the wearer's hips; and wherein the upper support portion, including the at least two upper tabs, is a solid body, the solid body being a single piece of material contoured to at least partially follow a contour of the wearer's upper back.

2. The carrier of claim 1, wherein the lower support portion is narrower than the upper support portion.

3. The carrier of claim 1, wherein the at least one holder includes a chest plate holder configured to receive a ballistic armor insert that protects the wearer's chest.

4. The carrier of claim 1, wherein the central upper edge is six to eighteen inches wide.

5. The carrier of claim 1, wherein each of the at least two upper tabs has a length in a range of 1 inch to 3 inches.

6. The carrier of claim 1, wherein each of the at least two upper tabs is shaped with at least one indentation configured to retain one of the shoulder straps.

7. The carrier of claim 1, wherein the lower support member is attached to the waist support member via a pivoting attachment that permits the upright support member to rotate from side to side on the wearer.

8. The carrier of claim 1, wherein the upper support portion includes two triangular cutouts proximally disposed in opposing relation such that a portion of upper support portion is sufficiently diagonal so that the upper support portion is semi-rigid.

9. The carrier of claim 1, wherein the upper support portion is a solid piece of polycarbonate.

10. The carrier of claim 1, wherein the upper support portion is perforated.

11. A carrier system comprising:

a vest defining a downwardly open support guiding sleeve that is substantially closed at an upper end;

a waist support member configured to secure the carrier system around the wearer's waist at a vertical location substantially corresponding to the wearer's hips; and an upright support member attached to the waist support member at a location substantially corresponding to the lateral middle of the wearer's back, the upright support member including a lower support portion extending vertically from the waist support member, and an upper support portion extending from the lower support portion to a position above a height of the wearer's shoulders;

wherein the upper support portion includes a central upper edge and at least two upper tabs that extend in a vertical direction beyond the central upper edge and vertically above the height of the wearer's shoulders, but not exceeding the height of the wearer's chin and not substantially extending horizontally over the height of the wearer's shoulders, wherein the at least two upper tabs are laterally separated from each other by the central upper edge and are disposed at lateral locations on the upper support portion corresponding to the wearer's shoulders, with the central upper edge disposed at a vertical location on the upper support portion no higher than the height of the wearer's shoulders, wherein the at least two upper tabs are configured such that the upright support member receives at least a portion of a shoulder load via the shoulder straps and the at least two upper tabs, with at least a portion of the shoulder load being transmitted downwardly through the at least two upper tabs and the upright support member to the wearer's hips, wherein the upper support portion, including the at least two upper tabs, is a solid body, the solid body being a single piece of material contoured to at least partially follow a contour of the wearer's upper back, and wherein the support guiding sleeve is configured to at least partially receive the upright support member.

12. The carrier system of claim 11, wherein the support guiding sleeve and the central upper edge are about six to eighteen inches wide.

13. The carrier system of claim 11, wherein the upright support member is attached to the waist support member in a manner that permits the upright support member to rotate laterally with respect to the waist support member.

14. The carrier system of claim 11, wherein each of the at least two upper tabs define a tab top edge having a strap retention device to prevent the vest from sliding laterally off the tab top edge.

15. The carrier system of claim 11, wherein the vest further comprises at least one armor pouch capable of receiving a ballistic armor insert.

16. The carrier system of claim 11, wherein the lower support portion is narrower than the upper support portion.

17. The carrier system of claim 11, wherein the central upper edge is six to eighteen inches wide.

18. The carrier system of claim 11, wherein each of the at least two upper tabs has a length in a range of 1 inch to 3 inches.

19. The carrier system of claim 11, wherein each of the at least two upper tabs is formed to extend forward of the central upper edge.

20. The carrier system of claim 11, wherein the upper support portion is a solid piece of polycarbonate.

* * * * *